United States Patent [19]

Camelio

[11] 4,043,493

[45] Aug. 23, 1977

[54] SKI CARRYING DEVICE AND METHOD

[76] Inventor: Joseph Robert Camelio, 38 Ward St., Randolph, Mass. 02368

[21] Appl. No.: 691,599

[22] Filed: June 1, 1976

[51] Int. Cl.[2] ..... B65D 71/00

[52] U.S. Cl. ..... 224/45 S; 280/11.37 A; 294/103 R

[58] Field of Search ..... 224/45 S, 45 N, 50; 280/11.37 C, 11.37 K, 11.37 A; 211/605 K; 70/14, 58; 24/16 R, 735 G, 81 SK; 294/34, 103 R

[56] References Cited

U.S. PATENT DOCUMENTS

| | | | |
|---|---|---|---|
| 2,173,709 | 9/1939 | Campbell | 294/34 |
| 2,550,424 | 4/1951 | Penn | 294/103 R |
| 2,559,190 | 7/1951 | Hallstream | 294/34 |
| 3,114,487 | 12/1963 | Miller et al. | 224/45 S |
| 3,366,297 | 1/1968 | Barsell | 224/50 |
| 3,892,343 | 7/1975 | Warner | 280/11.37 K |
| 3,893,606 | 7/1975 | Hofmann | 224/45 S |
| 3,990,655 | 11/1976 | Covell | 224/45 S |

FOREIGN PATENT DOCUMENTS

| | | | |
|---|---|---|---|
| 72,546 | 9/1947 | Norway | 280/11.37 A |

*Primary Examiner*—Robert J. Spar
*Assistant Examiner*—Kenneth Noland
*Attorney, Agent, or Firm*—Joseph H. Killion

[57] ABSTRACT

An improved Ski-carrying device is described which comprises a pair of substantially parallel first and second plate elements, each element having an inward lateral extension at the one end, each extension adapted to support the side of a ski placed thereon. There are means to connect the first and second plate elements together in a substantially parallel arrangement and to permit the plate elements to move between an expandable open position whereby skis to be carried may be each placed on the lateral extensions of the respective plate elements and a contractable closed carrying position whereby skis are secured and compressed between the closed plate elements. There are means to lock the first and second plate elements in the closed carrying position.

6 Claims, 3 Drawing Figures

SKI CARRYING DEVICE AND METHOD

BACKGROUND OF THE INVENTION

One of the chief inconveniences of skiing is the actual transportation of the ski equipment (e.g. skis and poles). Various carriers are known, but are not wholly satisfactory for various reasons.

For example, U.S. Pat. No. 3,086,688 teaches a complicated device for carrying a pair of skis in a parallel manner, however the device is lengthy, cumbersome and too intricate to be made economically and used effectively.

U.S. Pat. No. 3,114,847 discloses a one handled device that appears to be difficult to load and cumbersome to carry. Again the belts and buckles lead to a great number of parts for a ski carrier, and it appears to be somewhat unstable while in use.

U.S. Pat. No. 3,558,024 discloses a relatively simple device which also appears to be unstable and cumbersome in use, fits only one size of ski, and has no place for ski accessories, such as ski poles, There then appears to be a need for a ski carrier device which is simple to operate, stable while in use and inexpensive and simple in construction and has relatively few parts, and which overcomes the disadvantages of prior devices.

SUMMARY OF INVENTION

My invention relates to an improved ski carrying device and an improved method for transportation of skis.

I have discovered an improved ski carrying device which comprises a pair of substantially parallel first and second plate element, each element having an inward lateral extension at the one end, each extension adapted to support the side of a ski placed thereon. There are means to connect the first and second plate elements together in a substantially parallel arrangement and to permit the plate elements to move between an expandable open position whereby skis to be carried may be each placed on the lateral extension of the respective plate element and a contractable closed carrying position whereby skis are secured and carried between the closed plate elements. There are also means to lock the first and second plate elements in the closed carrying position.

My ski device permits the securing of a pair of skis, the transporting or carrying of the secured skis and the easy removal of the secured transported skis for use. In one embodiment my ski device also permits and provides a means to carry ski poles with the skis.

My method for the securing of skis for carrying comprises positioning a pair of skis between a pair of substantially parallel plate elements, each of which has an inward lateral extension at the one end of the plate element and the ski tips extending outwardly with the side of each ski supported by a lateral extension of each plate element. The plate elements are placed together in a closed carrying position to secure rigidly the skis therebetween. The plate elements are then locked in this closed carrying position.

In addition my method also provides after carrying of the skis to the position of use the removal of the secured skis by moving the plate elements from the closed contracted carrying position to a spring biased expandable position. The skis are then removed from the device.

Preferably and optionally my ski device is employed with a carry means such as a strap-like handle for use in carrying the secured skis in the case. Also optionally in another embodiment the inward side walls of the plate elements may contain a resilient material such as padding material, a flexible foam material, for example, a plasticized soft vinyl chloride resin foam, to aid in securing the skis in the device and to prevent injury or damage such as scratches to the ski surface by the plate elements. Optionally also my ski device may provide means to secure a pair of ski poles with the secured skis. For example by spring clips on the plate elements which fit over and secure the ski poles. In addition to prevent slippage of the skis in the device the lateral extension employed to hold the skis may have a resilient surface thereon. For example a roughened surface or a layer of skid resistant material like rubber secured thereto.

The means to contact the plate elements will be described in the preferred embodiment where a pair of connecting means are used. However it is recognized that a single or multiple means to connect may be employed for the same purpose.

This means to lock the plate elements in the closed carrying position is a simple clasp pin. However, when desired a more permanent locking mechanism such as a padlock or other means may be employed.

My invention provides numerous advantages over those devices found in the prior art. It is an advantage of my invention to provide a "universal" ski-carrying device which may be utilized with all types and sizes of skis and ski poles.

Further advantages of my invention are that the ski-carrying device is easy to move to open and closed positions; is secure and stable while in use; and is small and convenient to carry when it is not being used. Other advantages are that the ski-caddy is strong and durable, simple to manufacture, efficient and economical.

DETAILED DESCRIPTION OF THE DRAWINGS

Figure 1:
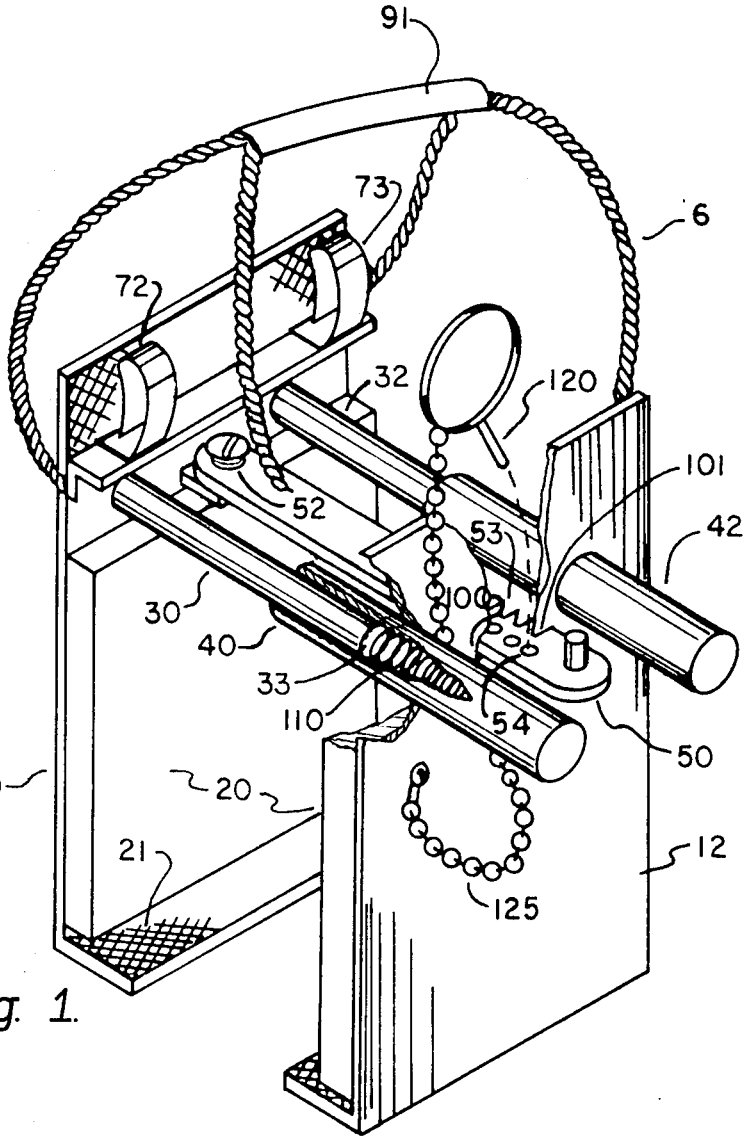
FIG. 1 is a perspective illustrative partially fragmented and cutaway view of the device with the exception of the rear surface of one of the plate elements.
Figure 2:
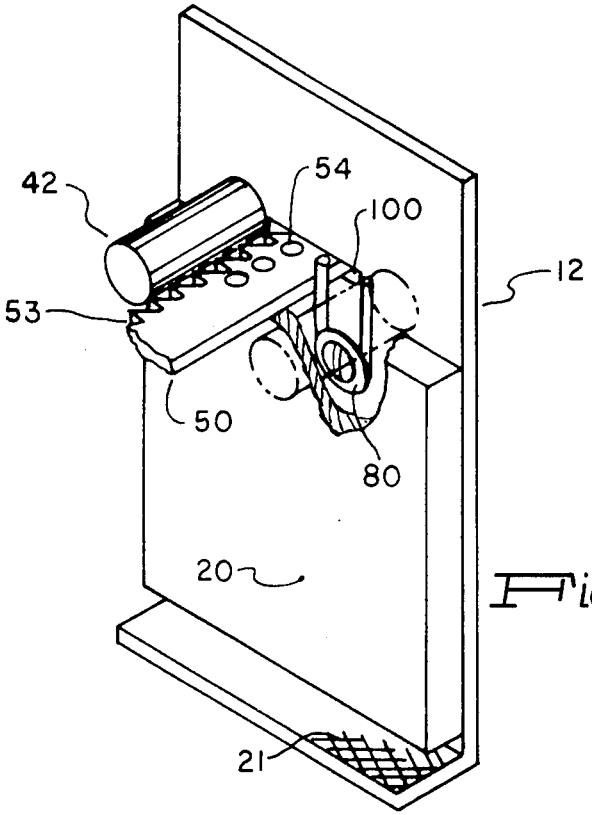
FIG. 2 is a perspective partially cutaway view of the rear surface of the plate element not shown in FIG. 1.

Referring now in particular to the accompanying drawings, my ski-device is generally indicated at 6 in FIG. 1 and includes a pair of plate elements 10 and 12 with sidewalls and inward lateral extensions 21 at one end thereof, having a layer of resilient material such as foam 20, affixed to the inner surface of each element. The upper surface of the extension is characterized by a grooved skid-resistent surface. Rods 30 and 32 are fixedly mounted on plate 10 and extend inwardly towards plate 12. Tubes 40 and 42 transfix plate 12 extending inwardly and fit over the ends of rods (end 33 of rod 30 shown). The rods and tubes are adjustable over a distance from a first expandable open position, where ski can be inserted, for example, where they are totally expanded to a second closed carrying position where they hold the plates against the skis for example. The rod end contacts springs for rod 30 shown compressing the springs as the ski device is contracted over the skis in the closed position. A saw-toothed blade member 50, having a series of saw teeth 53 and perforations 54, is affixed to plate 10 by fixture 52 so that it can only move in a direction perpendicular to said sidewalls. The saw-toothed member 50 is moved to a position where one of its edges contacts edge 101 of said opening which may also have engaging teeth of desired plate elements at a desired closed spacing position. Spring lock (FIG. 2) 80 aids in holding the saw-toothed member 50 at that spacing.

The end of safety clasp or pin 120 affixed to chain 125 secured to the plate 12 fits into one of the series of perforations on the saw-toothed member at the outer edge of sidewall 12 securing the ski device in the closed position. Upon removal of the safety clasp 120 and the movement of the saw-toothed member 50 away from the edge of the opening 100, the ski device "pops" open due to the stored energy of compression in the springs adjacent each rod end and the compression energy of the skis themselves. An inwardly projecting pin at the end of the plate member 50 prevents the plate elements from being separated in the open position.

Open ended spring clips 72 and 73 on plate 10 have an inward extension on the plate are used to retain ski poles with a similar arrangement on plate 12 (not shown). Two rope loop or strap loop members extend from each plate and are centrally received by a flexible handle 91 which fits over said member and allows the ski device to be carried readily.

In operation as the tubes 40 and 42 move over the rods 30 and 32, compressing the springs 110, the saw teeth 53 engage and disengage in a position at one side of the opening 100 in plate element 12. When the desired fit over the skis is reached, the saw-toothed member 50 is moved to the side, engages, and locks the plate elements in the carrying closed position. A spring-loaded locking spring 80 faces against the straight edge of the saw-toothed member to help fix the saw-toothed member in the locking position. A safety pin 120 fits into one of a series of perforations in the saw-toothed member to prevent the outward movement of the plate elements. When release of the skis from the device is desired, the safety pin 120 is removed and the saw-toothed member 50 moves away from the edge of the opening 100, disengaging the saw teeth and allowing the springs 110 to decompress. This force together with compression energy of the skis themselves, results in a "popping open" of the ski device to the open expandable position releasing the skis.

Figure 3:
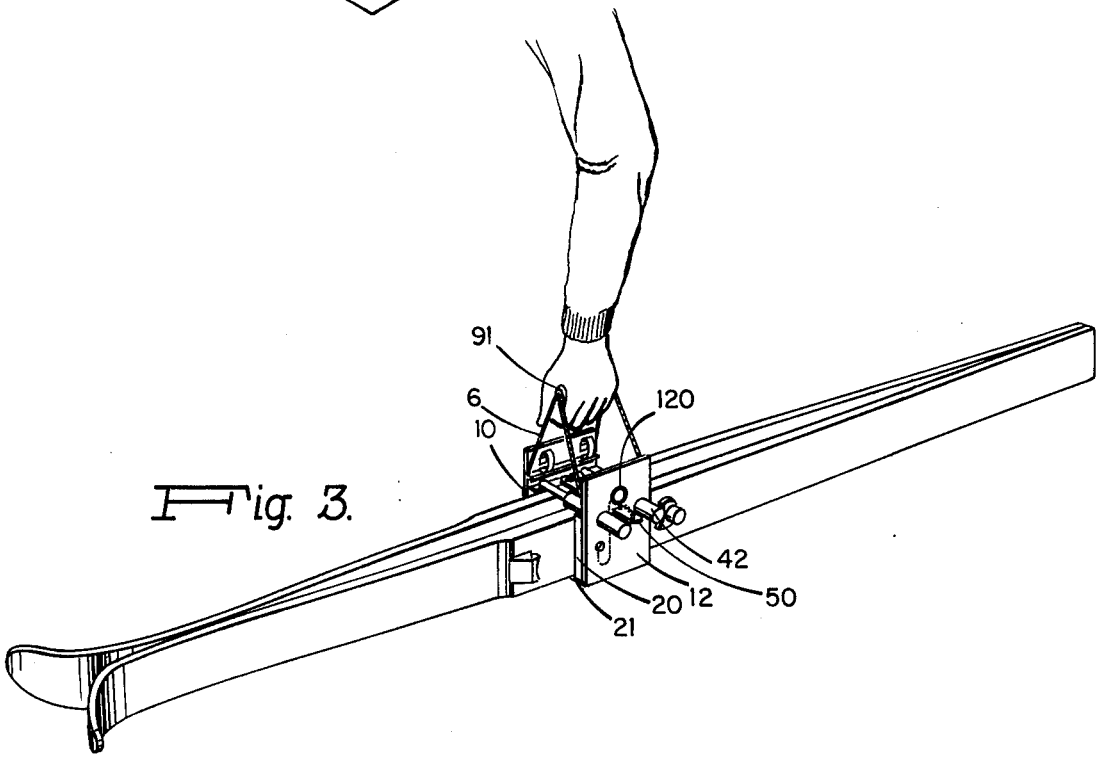
FIG. 3 is an illustrative view of my ski carrying device in use with a pair of skis secured therein.

Typically when the ski device is used the skis are aligned, bottom surface facing inward, ski tips outward, and the ski device is fitted over the skis, adjusted until tight, and locked into place. The ski device is positioned near the center of gravity of the skis for proper usage and balance. The outward force generated by the configuration of secured skis aids in keeping the skis in place. The ski poles are then clipped into place on clips 72 and 73 and the ski device is picked up and carried as shown more particularly in FIG. 3.

As illustrated and described my ski carrying device and method has numerous advantages over present devices used for securing and carrying skis and ski poles.

I claim:

1. A ski-carrying device which comprises:

a. a pair of substantially parallel first and second plate elements, each element having an inward lateral extension at the one end, each extension adapted to support the side of a ski placed thereon;

b. a pair of substantially parallel rod elements extending inwardly from the other end of the plate elements;

c. a pair of substantially parallel tube elements extending inwardly from the opposite surface of the plate elements and over the respective rod elements;

d. tension biased means in the tube elements which bias the plate elements toward the open expandable position; and e. the rod and tube elements positioned from the lateral extensions slightly above the width of the skis to be carried in the device.

f. a plate element characterized by an opening therein and which includes a locking element characterized by a plurality of saw teeth at the one end thereof and secured to and extending inwardly from the opposite plate element and through said opening in the said plate element, the saw teeth spring forward toward and adapted to engage in a locking manner the edge of the opening when the plate elements are in a closed carrying position and means to secure the locking element in the closed carrying position.

g. a handle means to carry the device with the skis secured therein.

2. The device of claim 1 wherein the locking element is characterized by a plurality of perforations at the one end thereof which extend outwardly of the plate element with the opening therein and when the means to secure the locking member includes a clasp member flexibly secured to the device and adapted to be inserted in said perforation to hold the locking member and the plate elements in a closed carrying position.

3. The device of claim 1 wherein the resistant material comprises a flexible resilient plastic foam layer.

4. The device of claim 1 which includes an inwardly extending lateral projection at the other end of each of the plate elements. Each of the lateral extensions at the other end adapted to support a ski pole thereon and means to secure a ski pole onto the lateral extension at the other end whereby a pair of ski poles may be carried with a pair of skis in the device.

5. In combination with the ski device of claim 1, a pair of skis, a side of each ski resting on the lateral extension at the end and of the plate elements in a closed carrying position, the skis held in a secure fixed position for transportation with the device.

6. The device of claim 1 wherein the locking element for this comprises:

a. spring means attached to said plate element characterized by an opening therein and pressing against said locking element on the side opposite said saw teeth to aid in retention of said locking element engaging the edge of the opening.

* * * * *